United States Patent [19]

Burcke, Jr.

[11] Patent Number: 4,945,901

[45] Date of Patent: Aug. 7, 1990

[54] HAND THERAPY APPARATUS AND METHOD THEREFOR

[76] Inventor: Harry J. Burcke, Jr., 1565 Kingswood Dr., Hillsborough, Calif. 94010

[21] Appl. No.: 327,019

[22] Filed: Mar. 22, 1989

[51] Int. Cl.[5] ..... A61H 9/00

[52] U.S. Cl. ..... 128/66; 128/64

[58] Field of Search ..... 128/66, 65, 24 A, 164

[56] References Cited

U.S. PATENT DOCUMENTS

| | | | |
|---|---|---|---|
| 653,708 | 7/1900 | Stanger | 128/66 |
| 695,971 | 3/1902 | Turch | 128/66 |
| 1,110,494 | 9/1914 | Kellogg | 128/38 |
| 1,740,624 | 12/1929 | Peel | 128/67 |
| 2,025,936 | 12/1935 | Clearman | 128/66 |
| 2,113,253 | 4/1938 | Gray | 128/66 |
| 2,272,481 | 2/1942 | Rinkes et al. | 128/66 |
| 2,970,073 | 1/1961 | Prange | 128/65 |
| 3,286,711 | 11/1966 | MacLeod | 128/65 |
| 3,565,065 | 2/1971 | Biggs | 128/66 |
| 3,757,806 | 9/1973 | Bhaskar et al. | 128/66 |
| 3,867,929 | 2/1975 | Joyner et al. | 128/24 A |
| 3,918,987 | 11/1975 | Kopfer | 128/66 |
| 4,192,297 | 3/1980 | Labrecque | 128/66 |
| 4,217,892 | 8/1980 | Brill | 128/66 |
| 4,402,331 | 9/1983 | Taldo et al. | 128/66 |
| 4,670,010 | 6/1987 | Dragone | 604/289 |

FOREIGN PATENT DOCUMENTS

| | | | |
|---|---|---|---|
| 8300645 | 3/1983 | PCT Int'l Appl. | 128/66 |

*Primary Examiner*—Edgar S. Burr
*Assistant Examiner*—Huong Q. Pham
*Attorney, Agent, or Firm*—Limbach, Limbach & Sutton

[57] ABSTRACT

The present invention discloses an improved hand therapy apparatus, wherein the hand is supported in an elevated upright position, and a therapeutic fluid and a therapeutic energy are directed at the hand.

9 Claims, 1 Drawing Sheet

HAND THERAPY APPARATUS AND METHOD THEREFOR

TECHNICAL FIELD

The present invention relates to an improved hand therapy apparatus and a method therefor and, more particularly, to a hand therapy apparatus in which the hand is supported in an elevated upright position and wherein a therapeutic fluid is directed at the hand.

BACKGROUND OF THE INVENTION

Devices for the treatment of limbs and, in particular, hands are well-known in the art. For example, see U.S. Pat. Nos. 4,670,010; 3,867,929; 3,565,065; 3,548,819; 3,186,404; 1,740,624; 1,110,494; 2,113,253 and 4,353,359.

None of the references, collectively or singularly, teaches or discloses an apparatus wherein the hand is placed in an elevated position and therapeutic devices can then work on the hand in order to promote the best therapeutic treatment for the hand.

SUMMARY OF THE INVENTION

In the present invention, a hand therapy apparatus is disclosed. The hand therapy apparatus has means for supporting the hand in an elevated upright position. A therapeutic fluid can be directed at the hand. Further, the temperature of the fluid is controllable. Finally, a therapeutic energy can be directed at the hand. The present invention also discloses a method for treating an injured hand.

DETAILED DESCRIPTION OF THE DRAWINGS

Figure 1:
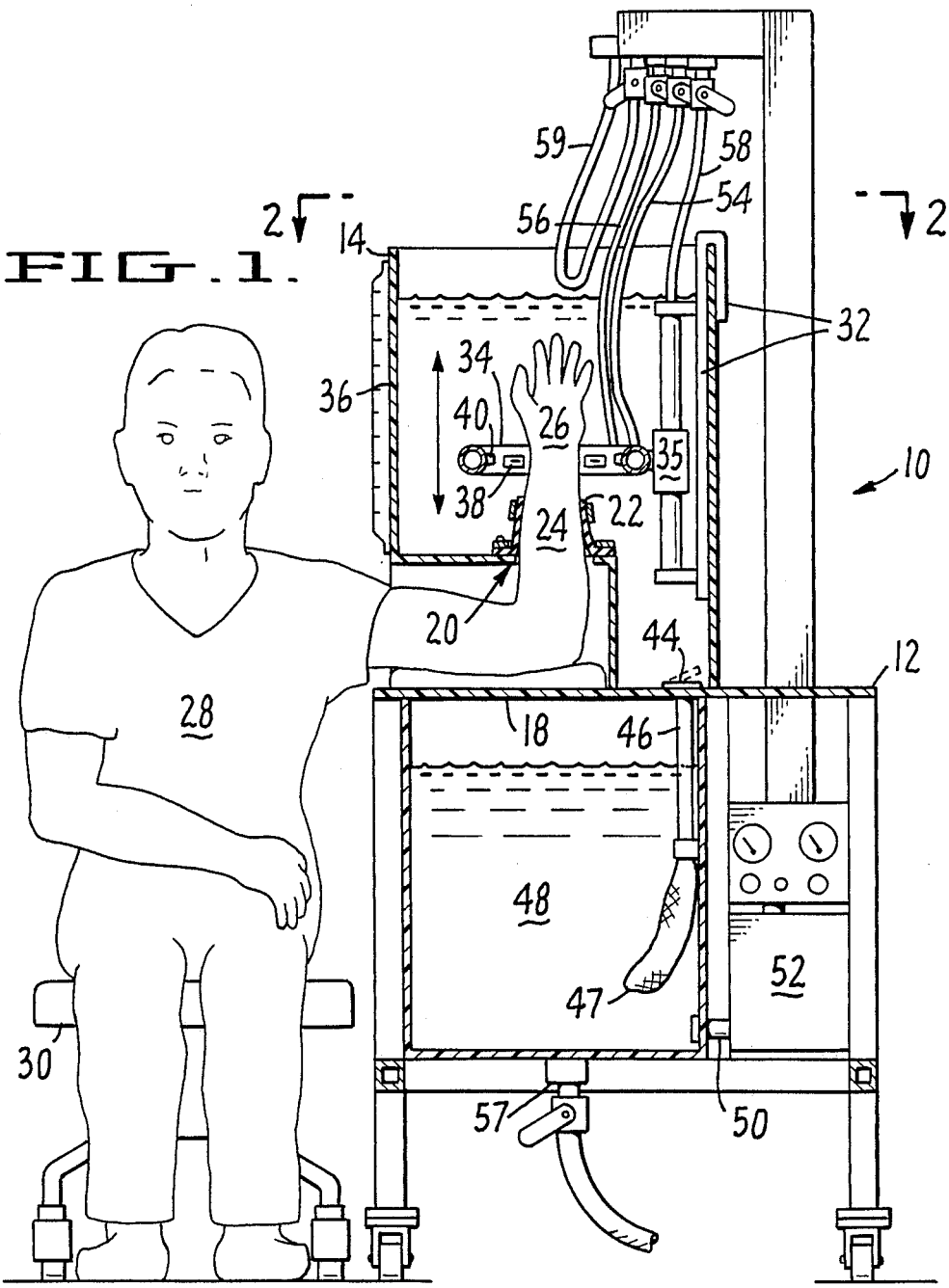
FIG. 1 is a side view with a partial cross-section showing the apparatus of the present invention in use with the patient.
Figure 2:
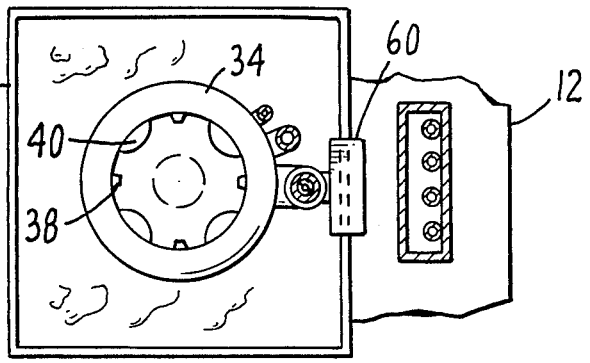
FIG. 2 is a cross-sectional view of the apparatus shown in FIG. 1 taken along the line 2—2.

Referring to FIG. 1, there is shown a partial cross-sectional side view of the hand therapy apparatus 10 of the present invention. The apparatus 10 comprises a cart 12 upon which is mounted a substantially rectangularly-shaped therapy tank 14 in an elevated position. The therapy tank 14 has an open or a top which is removable which exposes the entire therapy tank 14. The therapy tank 14 also comprises a bottom 18 which rests on the cart 12. Near the bottom 18 of the therapy tank 14 is an indentation permitting a hand 26 and forearm 24 to enter the tank 14 through a port 20, which is a horizontally oriented hole, with a sleeve 22. With the forearm 24 inserted through the hole 20 and the sleeve 22 of the therapy tank 14, the hand 26 is maintained in an elevated position with respect to the rest of the body of the patient 28. The patient 28 sits on an adjustable stool 30. However, as will be appreciated, the patient 28 can be positioned in any position so long as the hand 26 is positioned in an elevated position above the rest of the body of the patient 28, the significance of which will be explained hereinafter.

Within the rectangularly-shaped therapy tank 14 is a vertically-positioned removable stand 32. A support ring 34 is attached to the stand 32 and is movable in a vertical direction by a bidirectional hydraulic piston 35. A flexible hose 58 is connected to the bidirectional hydraulic piston 35. The vertical stand 32 also has a measurement calibration 36 to indicate the volume of fluid in the therapy tank 14. Circumferentially placed around the ring 34 is a plurality of hydrojets 38 positioned to direct a stream of water substantially at the center of the ring 34. Also positioned circumferentially around the ring 34 is a plurality of ultrasonic jets 40 which direct streams of acoustic energy towards the center of the ring 34.

On the bottom 18 of the therapy tank 14 is a first port 44 covered by a flap valve, which drains the fluid, water, from the therapy tank 14 through a first tubing 46, through a filter 47, into a holding tank 48. The holding tank 48 is positioned in the cart 12 and is below the therapy tank 14. A drain and valve 57 drains the water from the holding tank 48. From the holding tank 48, water is passed through a second tubing 50 into a pumping and heating apparatus 52. The pumping and heating apparatus 52 heats the water and pumps it back into the therapy tank 14 through the third tubing 54 and into the hydrojets 38. Electrical energy is also supplied to conduit 56 to the ultrasonic jets 40.

In the operation of the apparatus 10 of the present invention, as previously indicated, the hand 26 is initially placed in an elevated position with respect to the rest of the body of the patient 28. In this manner, during the therapy session, the hand is maintained continuously in an elevated position to reduce swelling, edema, scarring and thickening of the structures, such as ligaments, joints, tendons and skin, etc. With the hand 26 maintained in the elevated position gravity aids in lymphatic drainage and reduction of swelling. Further, various modalities of treatment can be brought to bear in a peristaltic distal to proximal (from the finger tips to forearm) direction, augmenting venous lymphatic drainage and reducing swelling. The various modalities of treatment can be directed to a specific area for concentrated therapy.

One of the modalities of treatment is the use of the hydrojets 38. The hydrojets 38 output a stream of warm water which can be directed to particular locations of the hand 26 and with the force of the hydrojets 38 varying for particular care. The jets 38 can be directed circumferentially from distal to proximal in a peristaltic fashion or they can be unidirectional to specific areas. Further, the temperature of the water from the hydrojets 38 can be varied by adjusting the amount of heating of the heating and pumping apparatus 52. In addition, because the jets 38 may be used for wound debridement and cleansing, bacterial and germicidal substances and/or transcutaneous medications can be added to the fluid. A fine filtration system 47 is interposed in the discharge line between the upper and lower tanks.

Further, as can be seen from the foregoing, the apparatus 10 can deliver sound waves focussed circumferentially, again, from a peristaltic distal-to-proximal direction or uni-direction to specific areas to help soften scar tissue, loosen adhesion, heat deeper structures, liquify interstitial thick and coagulated extravasated fluid. All of the foregoing help to promote venous lymphatic drainage, reduce swelling, and increase the range of motion of joints and tendons. The sonic jets 40 can deliver both sonic and ultrasonic sound waves.

Because the hydrojets 38 can deliver heated fluid, heat is another source of modality of treatment in the care of wound management. Heat increases circulation, decreases viscosity, increases flexibility, stretchability gliding action, relieving pain (most varieties) and promote healing by vaso dilation, increase delivery of cellular, drug, and metabolic factors.

Finally and most importantly, because the top is open, a hand therapist can manipulate and massage the hand 26 to increase exercise of the hand 26 and to apply more therapy to more specific areas. Thus, exercising tools can be brought into the therapy tank 14 through the open top for the hand 26 to perform exercises thereon. Further, the hand therapist can use a hand-held hydrojet/sonic jet unit 59 to direct various modalities of treatment to most specific areas of the hand 26.

From the foregoing, it can be seen that with the apparatus 10 of the present invention, all of the various modalities of treatment for the therapy of a hand can be brought to bear in a single apparatus 10 of the present invention.

What is claimed is:

1. A hand therapy apparatus comprising:

a tank having a removable top, a bottom and a port substantially near the bottom thereof for the insertion of said hand along with its forearm into said tank, said tank further having sleeve means for sealing said forearm in said port;

an adjustable support having a member encircling said hand for supporting said hand, substantially in an elevated totally upright position near the center of said tank;

means for directing a therapeutic fluid at said hand;

means for controlling the temperature of said fluid; and means for directing a therapeutic energy at said hand.

2. The apparatus of claim 1 wherein said member completely encircles said hand and is substantially in the shape of a ring,

3. The apparatus of claim 2 wherein said therapeutic fluid is water.

4. The apparatus of claim 3 wherein said means for directing said water comprises hydro jets positioned circumferentially about said ring.

5. The apparatus of claim 2 wherein said therapeutic energy is acoustic energy.

6. The apparatus of claim 5 wherein said means for directing said acoustic energy comprises sonic jets positioned circumferentially about said ring.

7. The apparatus of claim 2 further comprising:

a holding tank for storing said fluid;

a pump means for recirculating said fluid from said directing means to said holding tank; and a filtration means between aid directing means and said holding tank.

8. A method of treating an injured hand comprising:

inserting said hand with its forearm through a sleeve means into a tank having a removable top and a bottom, with said hand inserted through a port substantially near the bottom thereof;

sealing said forearm in said port;

supporting said hand in an elevated upright position by encircling said hand with a member mounted on an adjustable support positioned substantially near the center of the tank;

directing a therapeutic fluid at said hand; and directing a therapeutic energy at said hand.

9. The method of claim 8 further comprising the step of:

exercising said hand.

* * * * *

UNITED STATES PATENT AND TRADEMARK OFFICE

CERTIFICATE OF CORRECTION

PATENT NO. : 4,945,901

DATED : August 7, 1990

INVENTOR(S) : Harry J. Buncke, Jr.

It is certified that error appears in the above - identified patent and that said Letters Patent is hereby corrected as shown below:

On the title page, the inventor name "Burcke" should be --Buncke--.

In the Specification:

In column 2, line 67, after "stretchability" please insert --,--.

In the Claims:

In claim 2, column 4, line 3, please delete "," and replace with --.--.

In claim 7, column 4, line 18, please delete "aid" and replace with --said--.

Signed and Sealed this

Twenty-seventh Day of August, 1991

*Attest:*

HARRY F. MANBECK, JR.

*Attesting Officer*

*Commissioner of Patents and Trademarks*